US007462037B2

(12) United States Patent
Ju

(10) Patent No.: US 7,462,037 B2
(45) Date of Patent: Dec. 9, 2008

(54) ELECTRICAL CONNECTOR

(76) Inventor: Ted Ju, No. 15, Wu-Shiun Street, Anle District , Keelung, 204 (TW)

( * ) Notice: Subject to any disclaimer, the term of this patent is extended or adjusted under 35 U.S.C. 154(b) by 0 days.

(21) Appl. No.: 11/446,169

(22) Filed: Jun. 5, 2006

(65) Prior Publication Data

US 2007/0281501 A1 Dec. 6, 2007

(51) Int. Cl.
*H01R 12/00* (2006.01)

(52) U.S. Cl. ..... 439/66; 439/567

(58) Field of Classification Search ..... 439/66, 439/567

See application file for complete search history.

(56) References Cited

U.S. PATENT DOCUMENTS 5,324,205 A * 6/1994 Ahmad et al. ..... 439/66
5,480,316 A * 1/1996 Kinross et al. ..... 439/326
6,561,819 B1 * 5/2003 Huang et al. ..... 439/66
7,021,942 B2 * 4/2006 Grant et al. ..... 439/66

* cited by examiner

*Primary Examiner*—Truc T Nguyen
(74) *Attorney, Agent, or Firm*—Ming Chow; Sinorica, LLC

(57) ABSTRACT

An electrical connector with an electrically insulating elastic body is disclosed, comprising an electrically insulating elastic body and a multiple of electrical pieces inclinedly disposed in the electrically insulating elastic body. When the electrical connector is compressively contacted with external electronic devices, the electrical pieces will undergo rotating displacement; when the external electronic devices retreat from the compressive contact, the electrically insulating elastic body will push the electrical pieces back to their original positions. Compared with conventional prior art, the electrical piece of the electrical connector according to present invention can undergo rotating displacement to enable the electrical pieces to have larger elastic deformation, such that good contact can be ensured when the flatness of the connected electronic devices is poor and larger normal force on the electrical pieces can be obtained.

16 Claims, 7 Drawing Sheets

ELECTRICAL CONNECTOR

FIELD OF THE INVENTION

The present invention relates to an electrical connector and, in particular to an electrical connector with an electrically insulating elastic body.

BACKGROUND OF THE INVENTION

Conventional electrical connector, disclosed in the U.S. Pat. No. 3,795,037 for example, comprises an electrically insulating elastic body provided with a multiple of accommodating holes and electrical pieces disposed in the electrically insulating elastic body. The electrical pieces are of sidewise V-shape whose both ends are lower than the upper and upper surfaces of the electrically insulating elastic body and whose both ends' surfaces are plated with high conductive metal. When the electrical connector is connected with electronic devices, the elasticity of the electrically insulating elastic body is used to achieve the elastic contact between the electrical connector and the electronic devices. Consequently, the extent of elastic deformation of the electrical pieces is not large and thus its normal force is not high if the flatness of the connected electronic devices is not good.

Consequently, it is necessary to design a new electrical connector to overcome the shortcomings described above.

SUMMARY OF THE INVENTION

An object of the present invention is to provide an electrical connector provided with an elastic body.

In order to achieve the object described above, an electrical connector according to the present invention comprises: an electrically insulating elastic body provided with a multiple of accommodating grooves whose upper walls are inclinedly disposed; and at least an electrical piece accommodated in the accommodating grooves, such that when the electrical connector is compressively contacted with external electronic devices, the electrical piece will undergo rotating displacement; and when the external electronic devices retreat from the compressive contact, the electrically insulating elastic body will push the electrical pieces back to their original positions.

Compared with conventional prior art, the electrical piece of the electrical connector according to present invention can undergo rotating displacement to enable the electrical pieces to have larger elastic deformation, such that good contact can be guarantied when the flatness of the connected electronic devices is poor and larger normal force on the electrical pieces can be obtained.

BRIEF DESCRIPTION OF THE DRAWINGS

The present invention can be more fully understood by reference to the following description and accompanying drawings, in which.

DETAILED DESCRIPTION OF THE INVENTION

Figure 1:
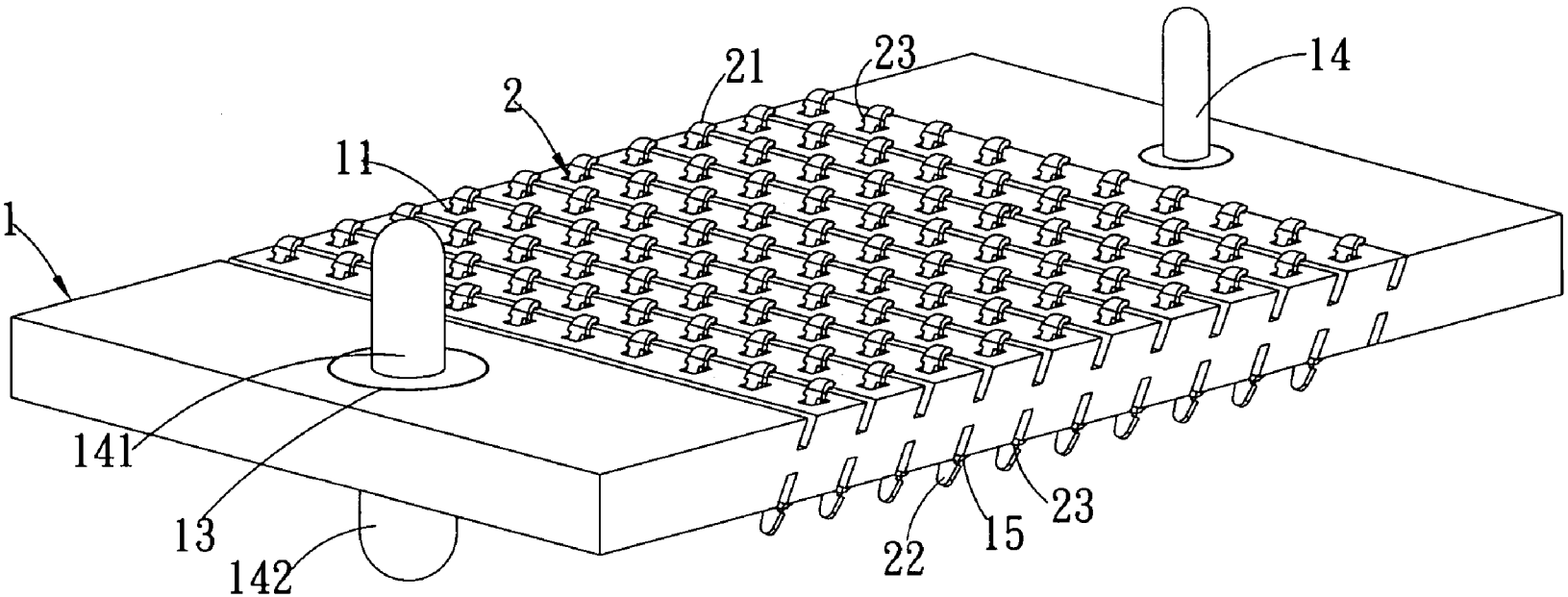
FIG. 1 schematically illustrates the perspective assembly view of a preferred embodiment of the electrical connector according to the present invention.

Referring to FIGS. 1 to 4, the electrical connector according to the present invention is used to connect the electronic devices 3 and 4, comprising an electrically insulating elastic body 1 and a multiple of electrical pieces 2 inclinedly disposed in the electrically insulating elastic body 1. When the electrical connector is compressively contacted with the external electronic device 3, the electrical pieces 2 will undergo rotating displacement; and when the external electronic device 3 retreats from the compressive contact, the electrically insulating elastic body 1 will push the electrical pieces 2 back to their original positions.

The elastic body 1 is approximately a rectangle provided with a multiple of accommodating grooves 11 to accommodate the electrical pieces 2. The upper walls of the accommodating grooves 11 are inclinedly disposed and an inclined groove 12 is disposed between two neighboring accommodating grooves 11. Both ends of the electrically insulating elastic body 1 are provided with a through hole 13, respectively, and each through hole 13 is inserted with a locating mechanism 14 (the locating mechanism 14 is, for example but not limited to, a locating bar in the present invention).

The locating mechanism 14 is a four-step bar, further comprising an upper locating bar 141, a lower locating bar 142, an upper limit portion 143 is extendingly and integratedly formed from the upper locating bar 141, and a lower limit portion 144 is extendingly and integratedly formed from the lower locating bar 142, wherein the upper and lower locating bars 141 and 142 are to locate the connected electronic devices 3 and 4, respectively, and the upper and upper limit portions 143 and 144 are to limit the compressing depth of the connected electronic devices 3 and 4, respectively.

Furthermore, the lower surface of the electrically insulating elastic body 1 is further provided with an encompassing block 15 is independently formed from the electrical piece 2, wherein the encompassing block 15 can protect the electrical piece 2 and the electrical piece 2 can swing to different angles because the encompassing block 15 and the electrical piece 2 are independently formed. Therefore, good contact can be obtained when the flatness of contact plane of the connected electronic devices 3 and 4 is poor. Of course, the encompassing block 15 of the electrical piece 2 and the electrical piece 2 can be integratedly formed. In this case, the encompassing block 15 can still protect the electrical piece 2, but when the flatness of contact plane of the connected electronic devices 3 and 4 is poor, it is likely to have poor contact between the electrical piece 2 and the connected electronic devices 3 and 4.

The electrical piece 2 is approximately a plate whose upper and lower portions form an upper and lower elastic contact portions 21 and 22, wherein at least one end is protrudingly provided with a retainer 23 to be retained on the corresponding side of the elastic body 1.

Figure 2:
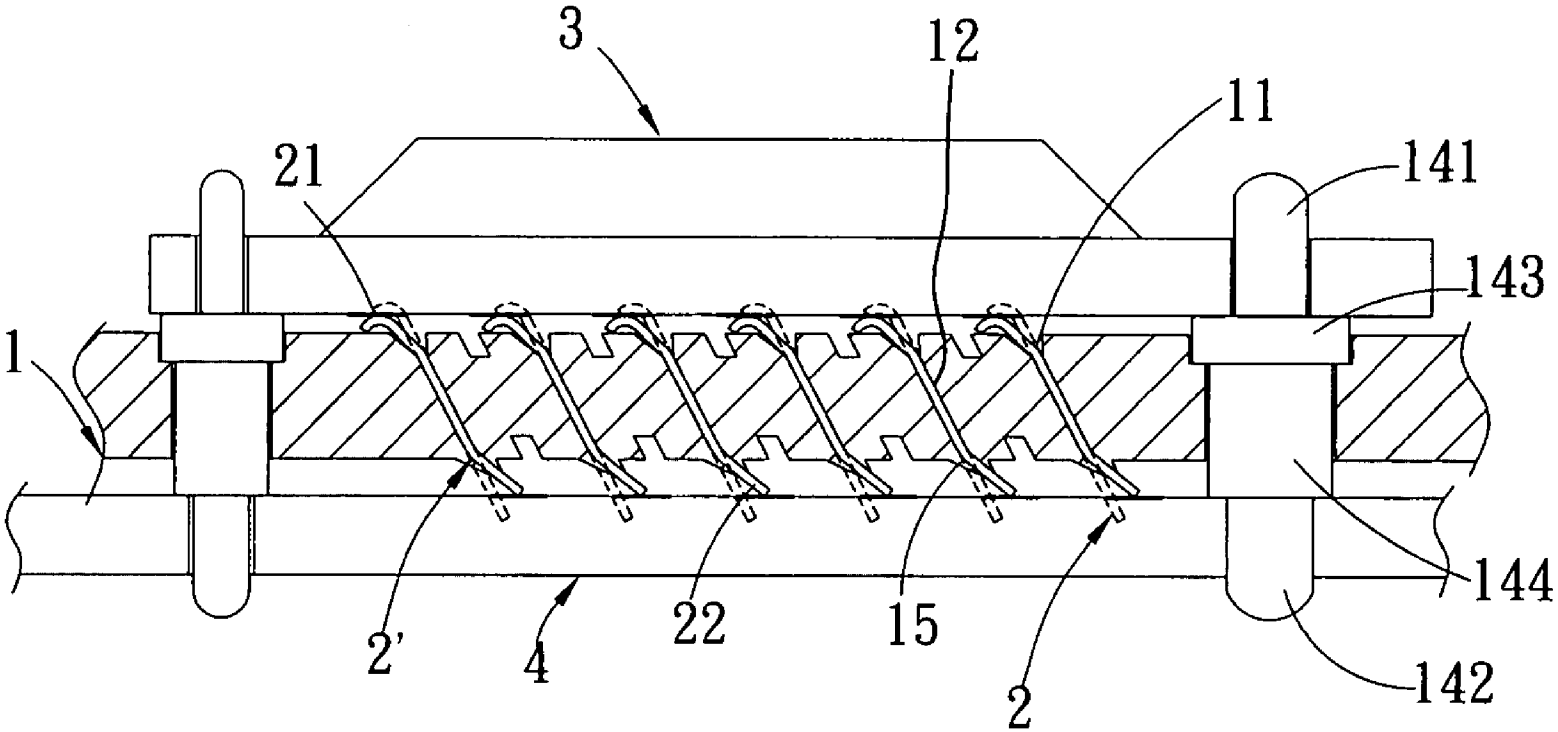
FIG. 2 schematically illustrates the sectional assembly view of a preferred embodiment of the electrical connector and a connected electronic device according to the present invention.
Figure 4:
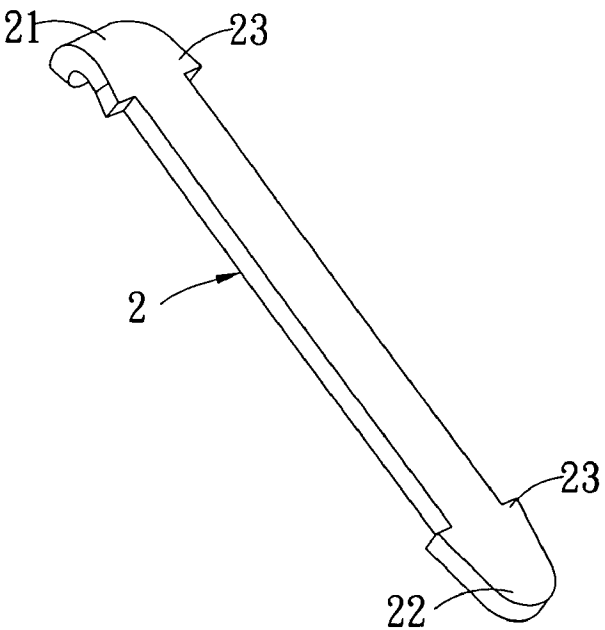
FIG. 4 schematically illustrates the perspective view of the electrical pieces of the electrical connector according to the present invention.
Figure 3:
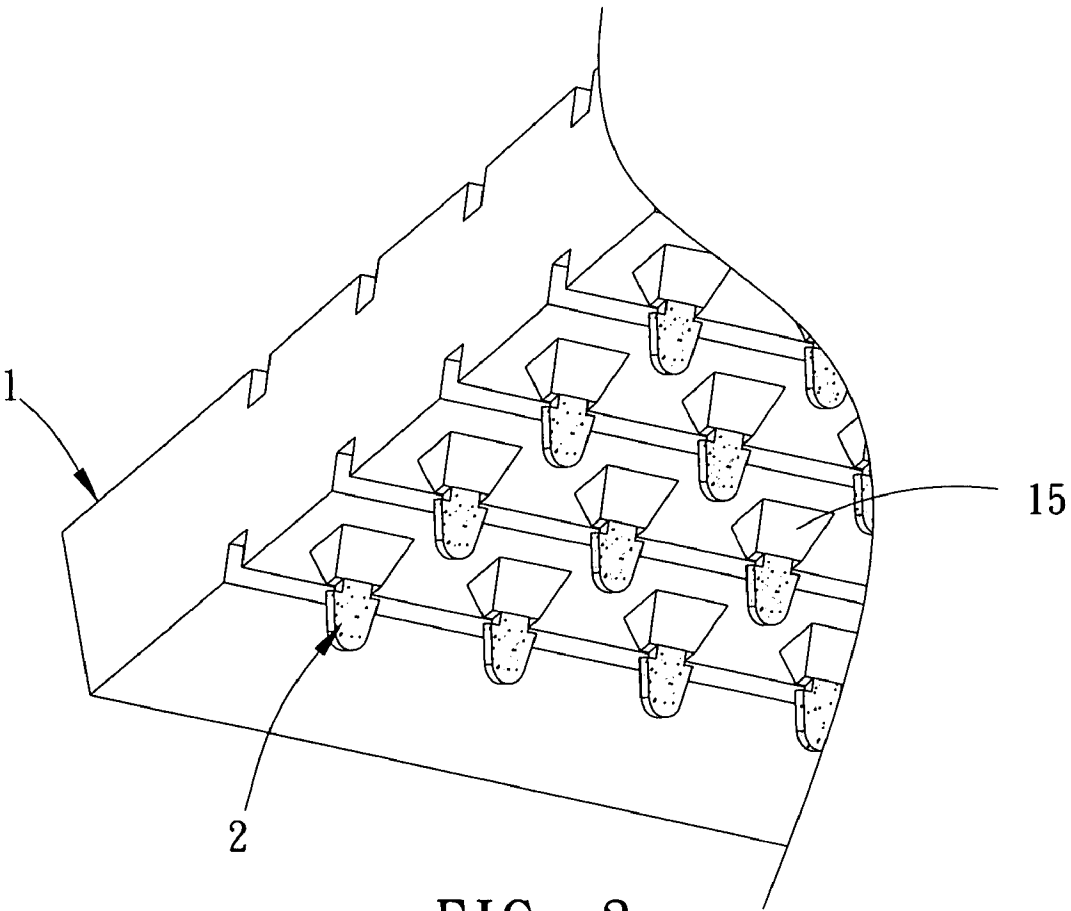
FIG. 3 schematically illustrates a close-up view of a preferred embodiment of the elastic body and the electrical pieces of the electrical connector according to the present invention.

When the electrical piece 2 is contacted with the connected electronic devices 3 and 4, because the elastic body 1 is electrically insulating and the elastic body 1 is cut to form an inclining groove 12, the electrical piece 2 is deformed under compressive force by rotating about a center to undergo rotating displacement. As shown in FIG. 2, the dotted lines represent the state of the electrical piece 2 without compressive force and the solid lines represent the electrical piece 2* undergoing rotating displacement under compressive force.

Figure 5:
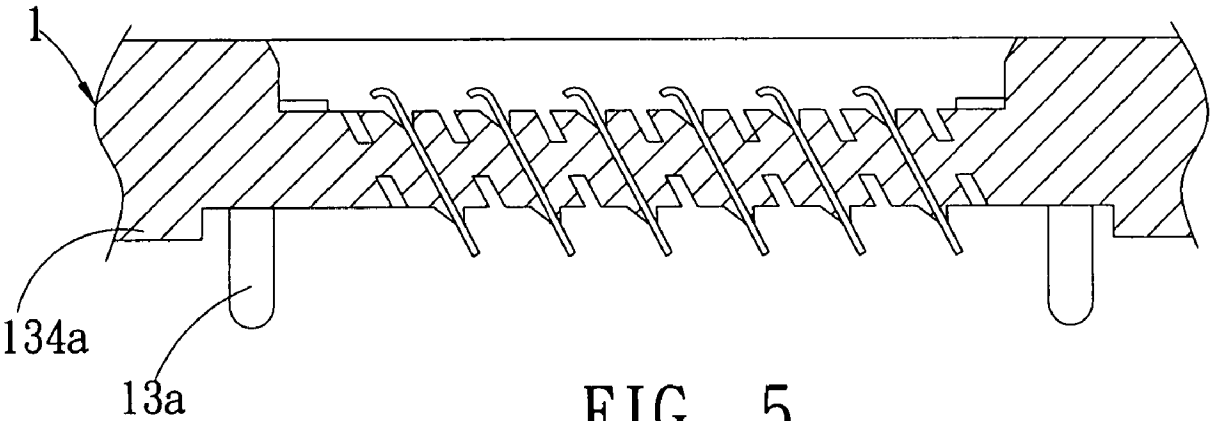
FIG. 5 schematically illustrates a partial cross-sectional view of another preferred embodiment of the electrical connector according to the present invention.
Figure 6:
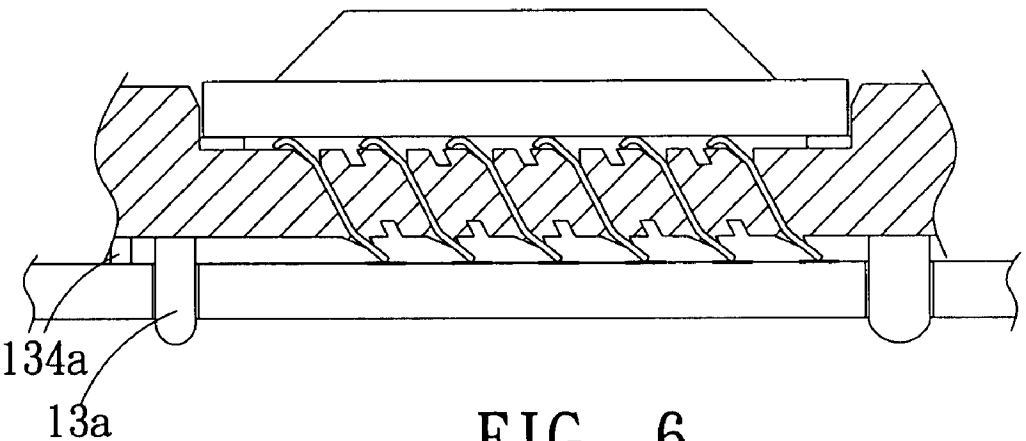
FIG. 6 schematically illustrates a sectional assembly view of the electrical connector and a connected electronic device of FIG. 5.

FIGS. 5 and 6 show the second embodiment of the present invention. The differences between the first and the second embodiments lie in that the locating mechanism 13*a* of the electrical connector is extendingly formed from the lower surface of the elastic body 1 and the lower limit portion 134*a* is also extendingly formed from the lower surface of the elastic body 1. Consequently, the second embodiment can provide the functions provided by the first embodiment.

Figure 7:
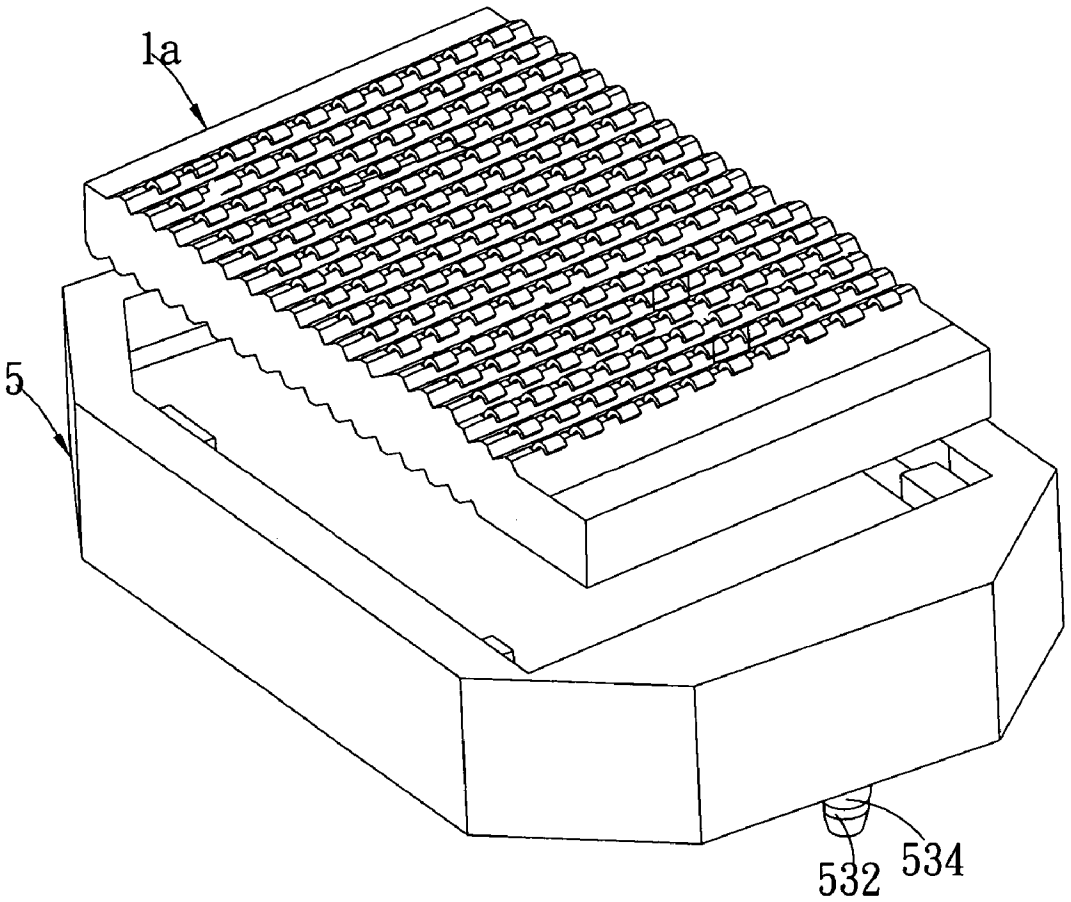
FIG. 7 schematically illustrates an exploded perspective view of still another preferred embodiment of the electrical connector according to the present invention.
Figure 8:
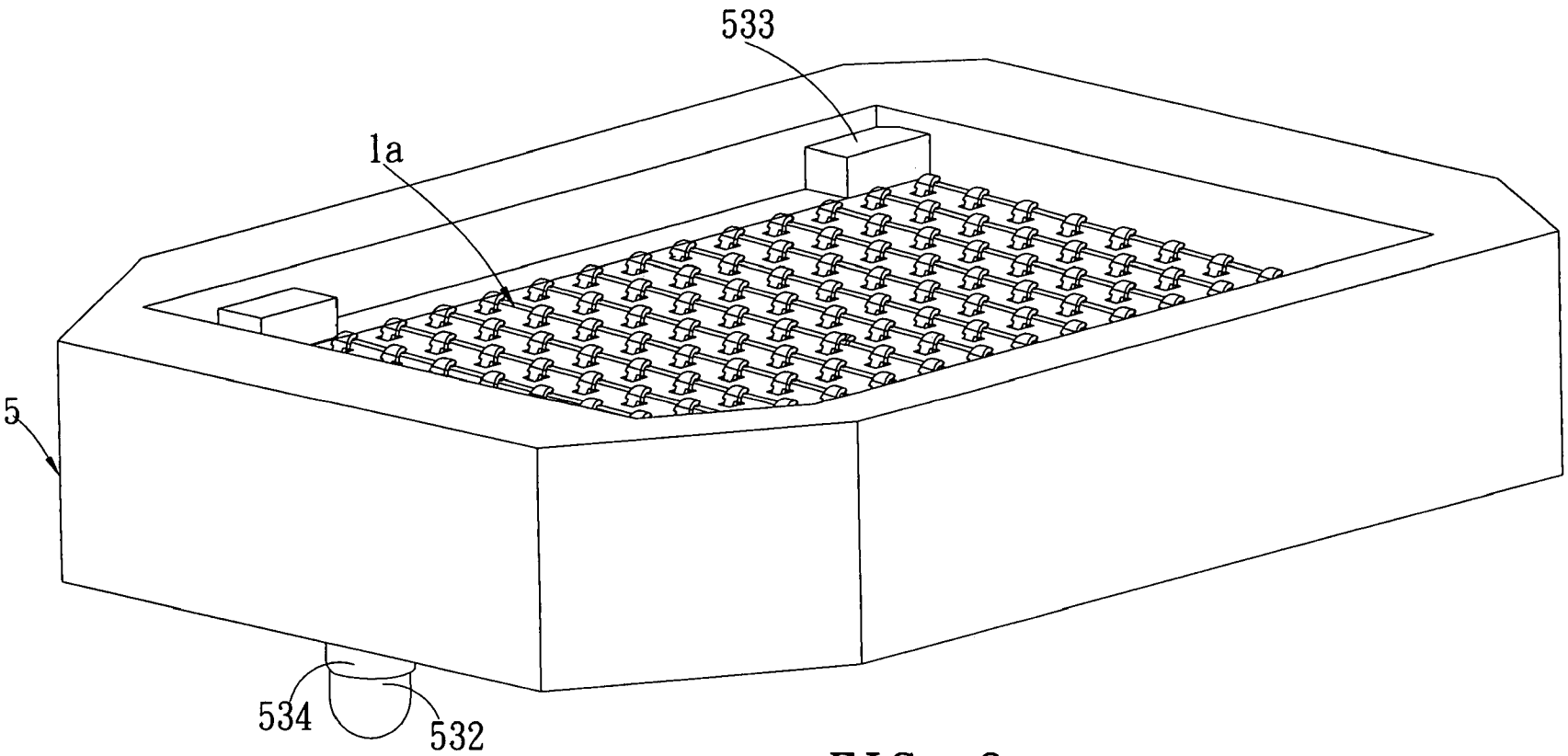
FIG. 8 schematically illustrates a perspective assembly view of the electrical connector of FIG. 7.

FIGS. 7 and 8 show the third embodiment of the present invention. The differences between the first and the third embodiments lie in that the electrical connector further comprises a frame 5 provided on the exterior of the elastic body 1*a* and independently formed from the elastic body 1*a* (of course, the frame 5 can also be integratedly formed with the elastic body 1*a*). The size and shape of the frame 5 are comparable to those of the elastic body 1*a*. The frame 5 is at least provided with two locating mechanisms 532 (in the present embodiment, the locating mechanisms 532 is, for example but not limited to, a locating bar extending from the lower surface of the frame 5). Also, the frame 5 is protrudingly provided with upper and lower limit portions 533 and 534 to limit the extent of compression of the connected electronic devices 3 and 4, respectively. Consequently, the third embodiment can provide the functions provided by the first embodiment.

Figure 9:
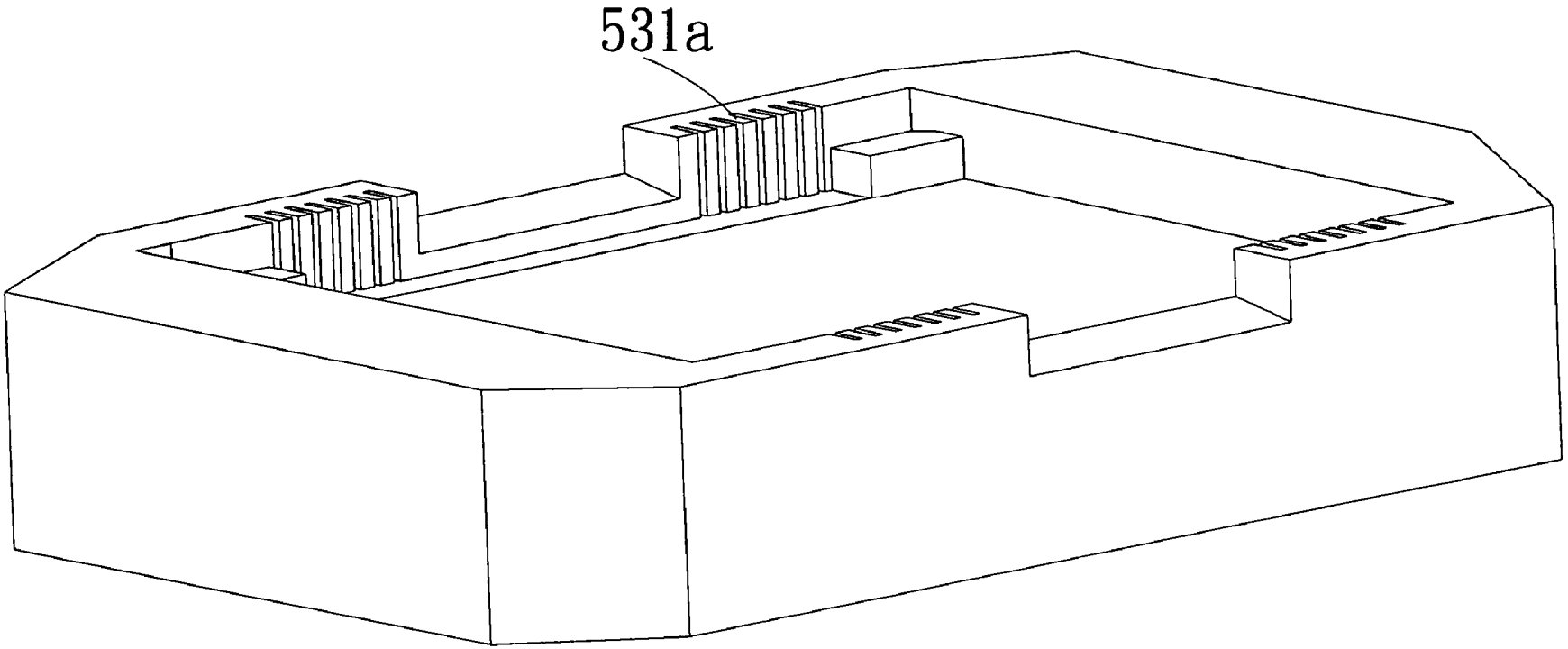
FIG. 9 schematically illustrates a perspective view of still another preferred embodiment of the electrically insulating elastic body according to the present invention.

FIG. 9 shows the fourth embodiment of the present invention. The differences between the first and the fourth embodiments lie in that the locating mechanism 531*a* is a locating block protrudingly provided on the frame 5*a*. Consequently, the fourth embodiment can provide the functions provided by the first embodiment.

Consequently, by putting the electrical connector provided with an electrically insulating elastic body according to the present invention into practice, when the electrical connector is compressively contacted with external electronic devices, the electrical pieces will undergo rotating displacement; when the external electronic devices retreat from the compressive contact, the electrically insulating elastic body will push the electrical pieces back to their original positions. Therefore, the electrical connector according to the present invention can indeed overcome the shortcomings of conventional electrical connectors.

While the invention has been described with reference to the a preferred embodiment thereof, it is to be understood that modifications or variations may be easily made without departing from the spirit of this invention, which is defined by the appended claims.

What is claimed is:

1. An electrical connector, comprising:

an electrically insulating elastic body provided with a multiple of accommodating grooves whose upper walls are inclinedly disposed; and at least an electrical piece accommodated in the accommodating grooves, wherein, when the electrical connector is compressively contacted with external electronic devices, the electrical piece will undergo rotating displacement and when the external electronic devices retreat from the compressive contact, the electrically insulating elastic body will push the electrical piece back to their original positions, wherein the upper and lower portions of the electrical piece form an upper and lower elastic contact portions, respectively, and at least one end is protrudingly provided with a retainer to be retained on the corresponding side of the electrically insulating elastic body.

2. The electrical connector as defined in claim 1, wherein both ends of the electrically insulating elastic body are provided with a through hole, respectively.

3. The electrical connector as defined in claim 1, wherein one side of the electrically insulating elastic body is further provided with an encompassing block to encompass the electrical piece.

4. The electrical connector as defined in claim 1, further comprising a frame provided on the exterior of the electrically insulating elastic body.

5. The electrical connector as defined in claim 1, wherein the electrical piece is approximately a plate.

6. The electrical connector as defined in claim 1, an inclined groove is further provided between two neighboring accommodating grooves.

7. The electrical connector as defined in claim 2, further comprising a locating mechanism inserted in the through hole.

8. The electrical connector as defined in claim 7, wherein the locating mechanism is a locating bar protrudingly provided in the electrically insulating elastic body.

9. The electrical connector as defined in claim 8, wherein the locating bar is extendingly provided with a limit portion to limit the compressing depth of the electronic device.

10. The electrical connector as defined in claim 3, wherein the electrically insulating elastic body and the encompassing block can be integratedly formed.

11. The electrical connector as defined in claim 4, wherein the frame is protrudingly provided with at least two locating mechanisms to locate the electronic devices.

12. The electrical connector as defined in claim 11, wherein the locating mechanism is a locating bar protrudingly provided on lower surface of the frame.

13. The electrical connector as defined in claim 11, wherein the locating mechanism is a locating block protrudingly provided on the frame.

14. The electrical connector as defined in claim 4, wherein the frame is further provided with a limit portion to limit the compressing depth of the electronic device.

15. An electrical connector, comprising:

an electrically insulating elastic body provided with a multiple of accommodating grooves whose upper walls are inclinedly disposed; and at least an electrical piece accommodated in the accommodating grooves, wherein, when the electrical connector is compressively contacted with external electronic devices, the electrical piece will undergo rotating displacement and when the external electronic devices retreat from the compressive contact, the electrically insulating elastic body will push the electrical piece back to their original positions, wherein one side of the electrically insulating elastic body is further provided with an encompassing block to encompass the electrical piece.

16. The electrical connector as defined in claim 15, wherein the electrically insulating elastic body and the encompassing block can be integratedly formed.

* * * * *